US007546720B2

(12) United States Patent
Leary

(10) Patent No.: US 7,546,720 B2
(45) Date of Patent: Jun. 16, 2009

(54) METHOD AND APPARATUS FOR INSTALLING A POST MOUNT

(75) Inventor: Steven J. Leary, Barnegat, NJ (US)

(73) Assignee: Vinylast, Inc., Lakewood, NJ (US)

( * ) Notice: Subject to any disclaimer, the term of this patent is extended or adjusted under 35 U.S.C. 154(b) by 459 days.

(21) Appl. No.: 11/375,769

(22) Filed: Mar. 15, 2006

(65) Prior Publication Data

US 2007/0215767 A1 Sep. 20, 2007

(51) Int. Cl.
*E04G 21/00* (2006.01)

(52) U.S. Cl. ..... 52/745.17; 52/155; 52/169.9; 248/346.01

(58) Field of Classification Search ..... 52/155, 52/165, 169.9, 745.17; 248/346.01, 346.03, 248/188.1, 231.31, 523
See application file for complete search history.

(56) References Cited

U.S. PATENT DOCUMENTS

| | | | | |
|---|---|---|---|---|
| 4,078,757 | A * | 3/1978 | Waters | 248/441.1 |
| 4,852,501 | A * | 8/1989 | Olson et al. | 108/107 |
| 5,946,871 | A * | 9/1999 | Kassardjian et al. | 52/301 |
| 5,982,093 | A * | 11/1999 | Nihashi et al. | 313/542 |
| 6,948,283 | B2 * | 9/2005 | Burkart et al. | 52/155 |
| 7,278,240 | B2 * | 10/2007 | Burkart et al. | 52/155 |

* cited by examiner

*Primary Examiner*—Richard E Chilcot, Jr.
*Assistant Examiner*—Chi Q Nguyen

(57) ABSTRACT

In one embodiment, the invention is a method and apparatus for installing a post mount. In one embodiment, a method for securing a post mount to a support surface includes assembling the post mount, where the post mount includes: a support pipe having a first end and a second end, a first support block coupled to the first end of the support pipe, and a second support block coupled to the second end of the support pipe. At least one fastener is then inserted through the first support block and through the support surface.

16 Claims, 7 Drawing Sheets

METHOD AND APPARATUS FOR INSTALLING A POST MOUNT

FIELD OF THE INVENTION

The present invention relates generally to railings and relates more specifically to support hardware for use in railing installations.

BACKGROUND OF THE DISCLOSURE

Post mounts are frequently used in the construction of decks, porches, stairs and other structures that include railings. FIG. 1, for example, is a schematic illustration of a portion of an exemplary railing system 100, including a post mount 108. The railing system 100 comprises a railing 102, a support surface 104, and a plurality of posts $\mathbf{106}_1$-$\mathbf{106}_n$ (hereinafter collectively referred to as "posts 106"). Generally, the rail 102 is supported in a spaced-apart relation relative to the support surface 104 by the posts 106.

In order to mount the posts 106 to the support surface 104 (which may comprise, for example, wood or concrete) in a substantially invisible manner (i.e., little or no outwardly visible hardware), post mounts are often first installed in the support surface 104. For example, the post $\mathbf{106}_1$ is mounted to the support surface via a post mount 108 (illustrated in phantom). Specifically, the post mount 108 is fastened to the support surface 104 in a secure manner, and the hollow post $\mathbf{106}_1$ is then slipped over the post mount 108, like a sleeve. In this manner, the post $\mathbf{106}_1$ is supported securely by the support surface 104 and in turn provides secure support for the railing 102. It is clear that the strength afforded by the join of the post mount 108 to the support surface 104 and the resistance of the post mount 108 to upward force (e.g., pulling) is a major factor in the overall structural integrity of the railing system 100.

Thus, there is a need in the art for an apparatus for installing a post mount.

SUMMARY OF THE INVENTION

In one embodiment, the invention is a method and apparatus for installing a post mount. In one embodiment, a method for securing a post mount to a support surface includes assembling the post mount, where the post mount includes: a support pipe having a first end and a second end, a first support block coupled to the first end of the support pipe, and a second support block coupled to the second end of the support pipe. At least one fastener is then inserted through the first support block and through the support surface.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the invention is a method and apparatus for installing a post mount. Embodiments of the present invention provide for a strengthened join where a post mount is secured to a support surface, resulting in a more secure mount over which to slip a post of a railing system. Moreover, the post mount can be easily adjusted to accommodate posts of various sizes, simply by slipping an adapter over a portion of the post mount.

Figure 1:
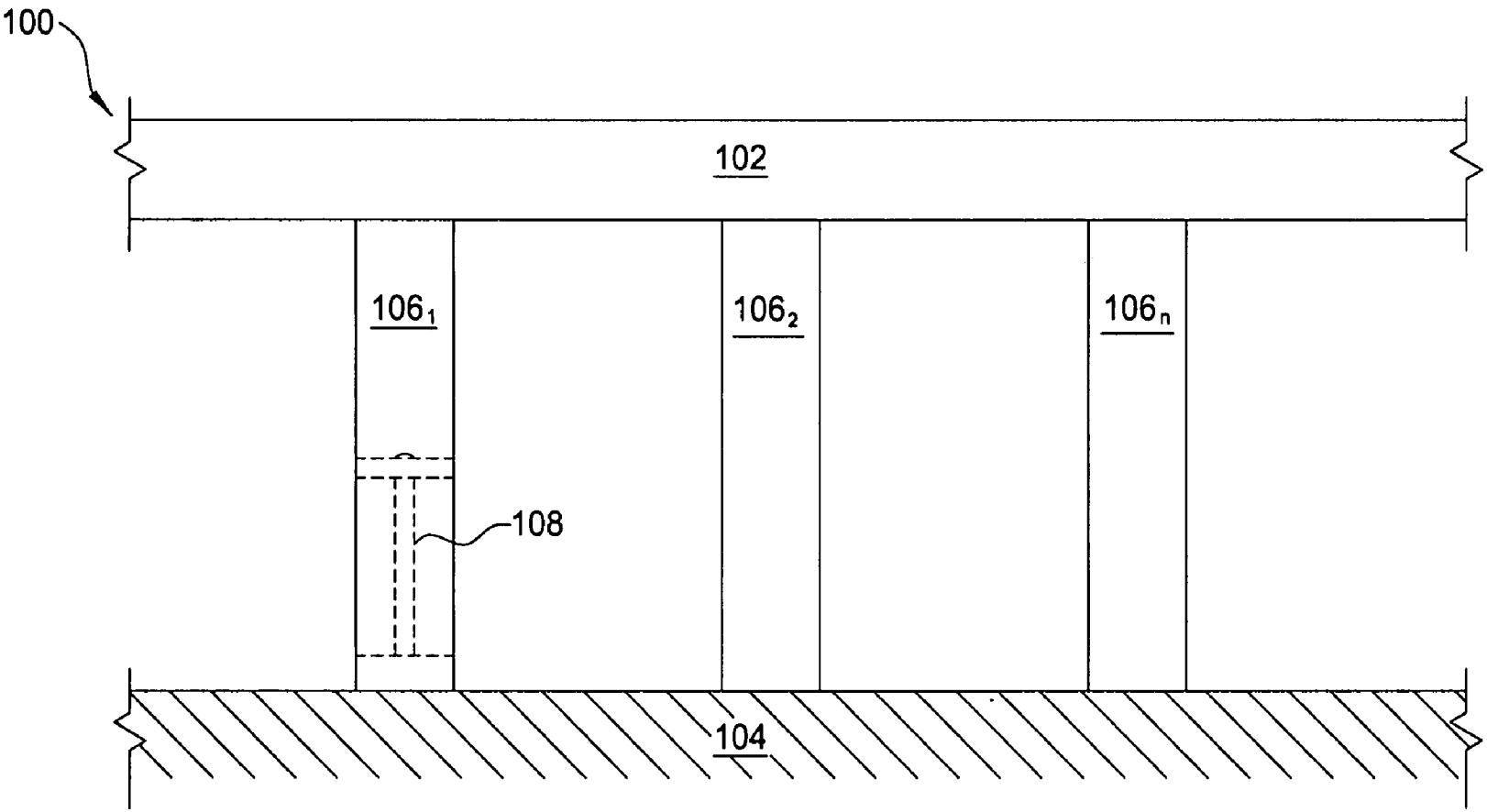
FIG. 1 (PRIOR ART)
FIG. 1 is a schematic illustration of a portion of an exemplary railing system, including a post mount.
Figure 2:
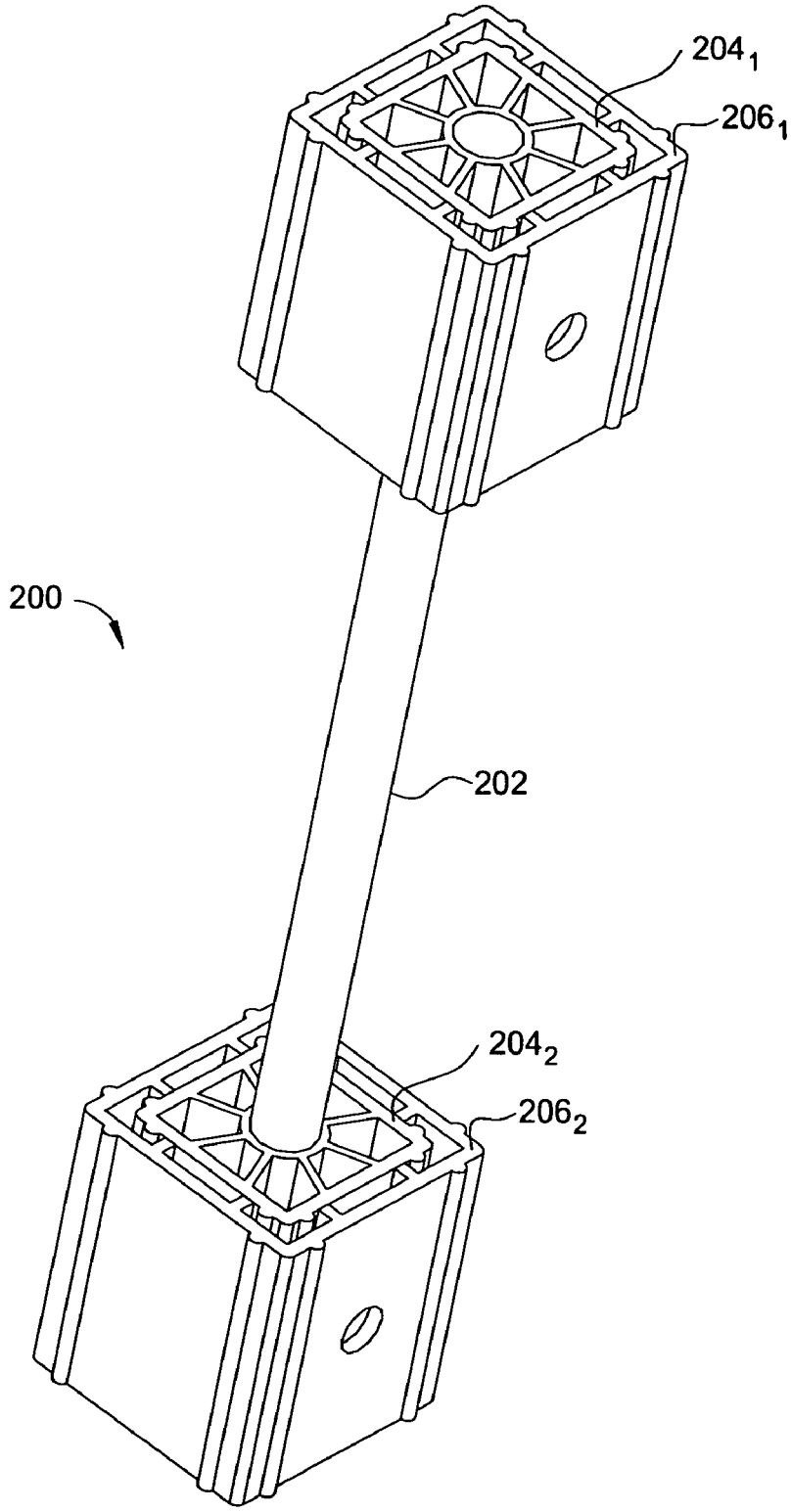
FIG. 2 is a perspective view of one embodiment of a post mount, according to the present invention.

FIG. 2 is a perspective view of one embodiment of a post mount 200, according to the present invention. The post mount 200 comprises a support pipe 202 supported between a first support block $\mathbf{204}_1$ and a second support block $\mathbf{204}_2$ (hereinafter collectively referred to as "support blocks 204"). In installation, one of the first support block $\mathbf{204}_1$ or the second support block $\mathbf{204}_2$ is mounted to a support surface (e.g., a wood or concrete support surface) such that a hollow post may be slipped over the post mount 200, as described above. The outer perimeters of the support blocks 204 are sized to be slightly smaller than the inner perimeter of a post slipped thereover, such that the post is snugly supported by the support blocks 204.

In one embodiment, the post mount 200 further comprises an adapter $\mathbf{206}_1$ or $\mathbf{206}_2$ (hereinafter collectively referred to as "adapters 206") slipped over at least one of the first support block $\mathbf{204}_2$ and the second support block $\mathbf{204}_2$. The adapter 206 increases the outer perimeter of the support block 204 over which it is slipped, thereby enabling the post mount 200 to be used in connection with a larger-perimeter post.

Figure 3B:
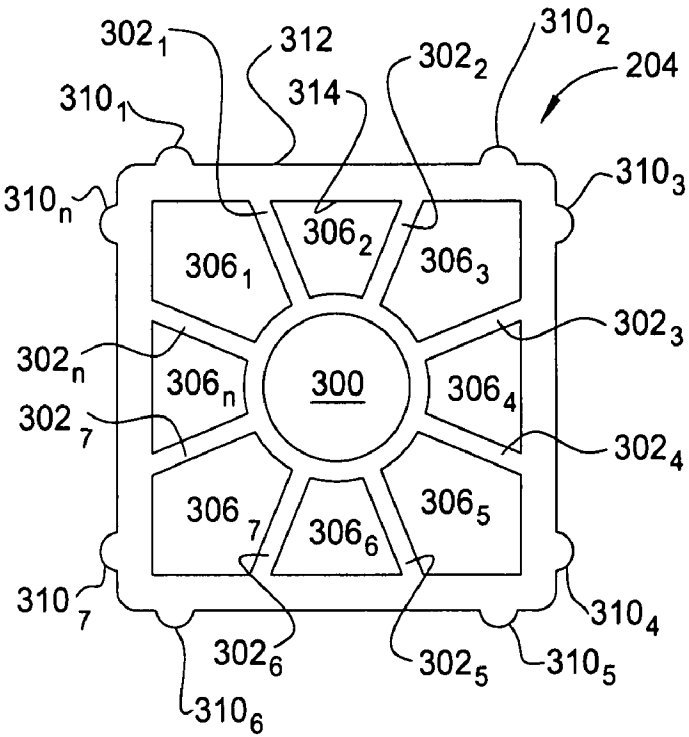
FIG. 3B is a cross-sectional view of the support block of FIG. 3A, taken along line A-A' of FIG. 3A.
Figure 3A:
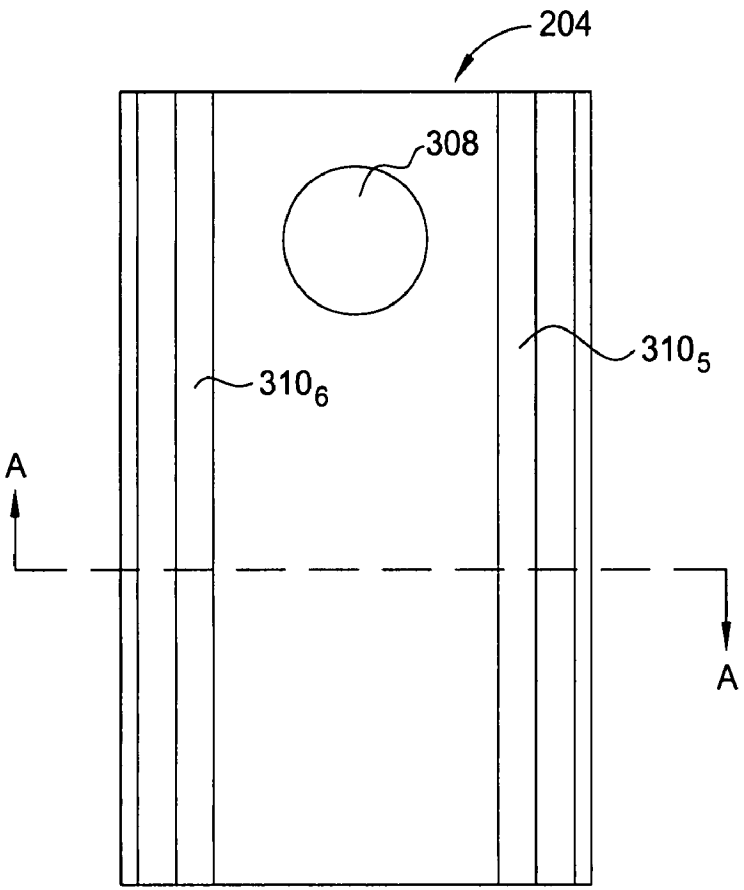
FIG. 3A is a plan view of one embodiment of a support block, according to the present invention.

FIG. 3A is a plan view of one embodiment of a support block 204, according to the present invention. FIG. 3B is a cross-sectional view of the support block 204, taken along line A-A' of FIG. 3A. Referring simultaneously to FIGS. 3A and 3B, the support block 204 is an elongated block having a substantially square cross-section. At least one aperture 308 is defined in at least one face of the support block 204 and is sized to receive a fastener for securing the support block 204 to a support pipe (which includes a similar aperture). In one embodiment, the support block 204 is formed of a rigid plastic or composite, such as polypropylene, polyethylene or the like.

The outer perimeter 312 of the support block 204 further includes a plurality of longitudinal ridges $\mathbf{310}_1$-$\mathbf{310}_n$ (hereinafter collectively referred to as "ridges 310") defined thereon. In one embodiment, two ridges 310 are defined on each face of the support block 204. The ridges 310 are orientated in a spaced-apart, substantially parallel manner relative to each other and are adapted to contact the inner perimeter of a hollow post (not shown) or an adapter 206 slipped over the support block 204.

As illustrated in FIG. 3B, a longitudinal bore 300 is disposed substantially through the center of the support block 204. The longitudinal bore 300 is sized to received a support pipe. A plurality of flanges $\mathbf{302}_1$-$\mathbf{302}_n$ (hereinafter collectively referred to as "flanges 302") radiate outwardly from the bore 300 toward the inner perimeter 314 of the support block 204. In one embodiment, two flanges 302 extend from the bore 300 to each face of the support block's perimeter (i.e., for a total of eight flanges 302).

The flanges 302 define a plurality of hollow longitudinal volumes $\mathbf{306}_1$-$\mathbf{306}_n$ (hereinafter collectively referred to as "volumes 306") within the support block 204. In one embodiment (i.e., where eight flanges 302 extend outwardly from the bore 300), eight such volumes 306 are defined. These include one volume 306 defined at each corner of the support block's cross section.

Figure 4B:
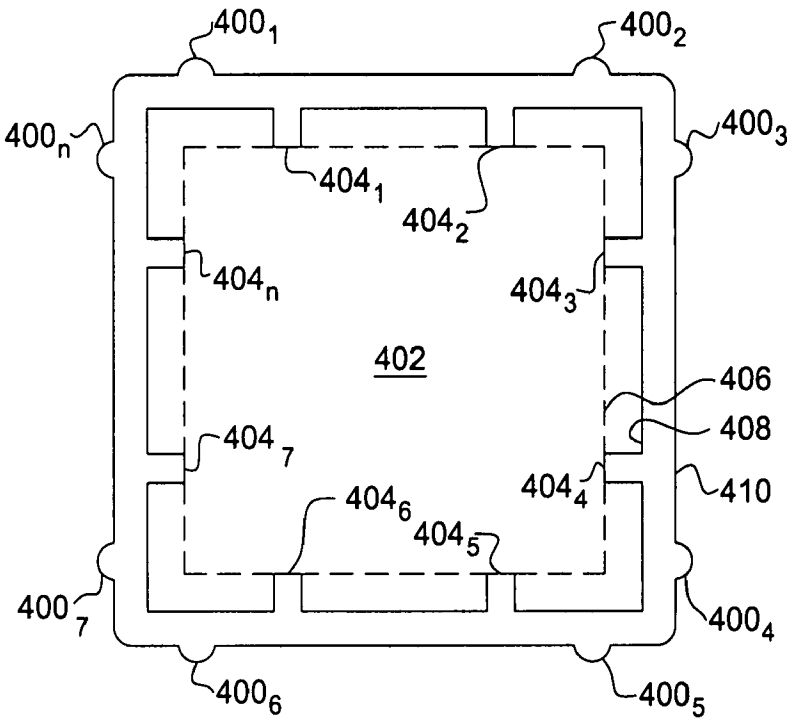
FIG. 4B is a cross-sectional view of the adapter of FIG. 4A, taken along line A-A' of FIG. 4A.
Figure 4A:
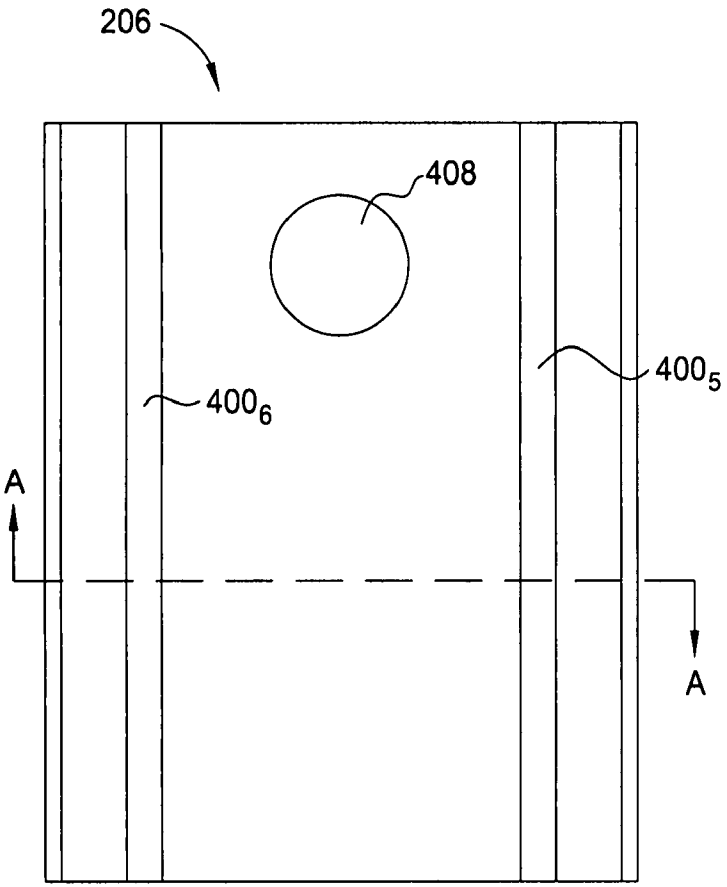
FIG. 4A is a plan view of one embodiment of an adapter, according to the present invention.

FIG. 4A is a plan view of one embodiment of an adapter 206, according to the present invention. FIG. 4B is a cross-sectional view of the adapter 206, taken along line A-A' of FIG. 4A. Referring simultaneously to FIGS. 4A and 4B, the adapter 206 is an elongated block having a substantially square cross-section. At least one aperture 408 is defined in at least one face of the adapter 206 and is sized to receive a fastener, for securing the adapter 206 to a support block 204 and a support pipe (which include similar apertures). In one embodiment, the adapter 206 is formed of a rigid plastic or composite, such as polypropylene, polyethylene or the like.

The outer perimeter 410 of the adapter 206 further includes a plurality of longitudinal ridges $\mathbf{400}_1$-$\mathbf{400}_n$ (hereinafter collectively referred to as "ridges 400") defined thereon. In one embodiment, two ridges 400 are defined on each face of the adapter 206. The ridges 400 are orientated in a spaced-apart, substantially parallel manner relative to each other.

As illustrated in FIG. 4B, the adapter 206 has a substantially hollow interior volume 402. A plurality of short flanges $\mathbf{404}_1$-$\mathbf{404}_n$ (hereinafter collectively referred to as "flanges 404") radiate inwardly from the inner perimeter 408 of the adapter 206. The flanges 404 are short enough that none of the flanges 404 intersect. In particular, the flanges 404 are sized such that an effective inner perimeter 406 (illustrated in phantom) of the adapter 206, defined by the flanges 204, is slightly larger than the outer perimeter 312 of the support block 204 (but smaller than the actual inner perimeter 408 of the adapter 206). In one embodiment, two flanges 404 extend from each face of the adapter's actual inner perimeter 408 (i.e., for a total of eight flanges 404).

In order to increase the outer perimeter size of a support block 204, the adapter 206 is slid over the support block 204, like a sleeve. The flanges 404 of the adapter 206 contact the outer perimeter 312 of the support block 204 and rest substantially flush thereagainst. Moreover, the flanges 404 of the adapter 206 are positioned to rest substantially flush against the longitudinal ridges 310 on the outer perimeter 312 of the support block 204. This substantially ensures that the adapter 206 fits snugly over the support block 204 and will not allow travel of the support block 204 therewithin. In one embodiment, a snug fit is enhanced by providing a small interior ridge or shelf (not shown) in the interior volume 402 of the adapter 206. The shelf extends inwardly from the actual inner perimeter 408 of the adapter 206 to approximately the effective inner perimeter 406, and extends at least partially around the actual inner perimeter 408. In one embodiment, the shelf is formed approximately midway along the length of the adapter 206.

Figure 5:
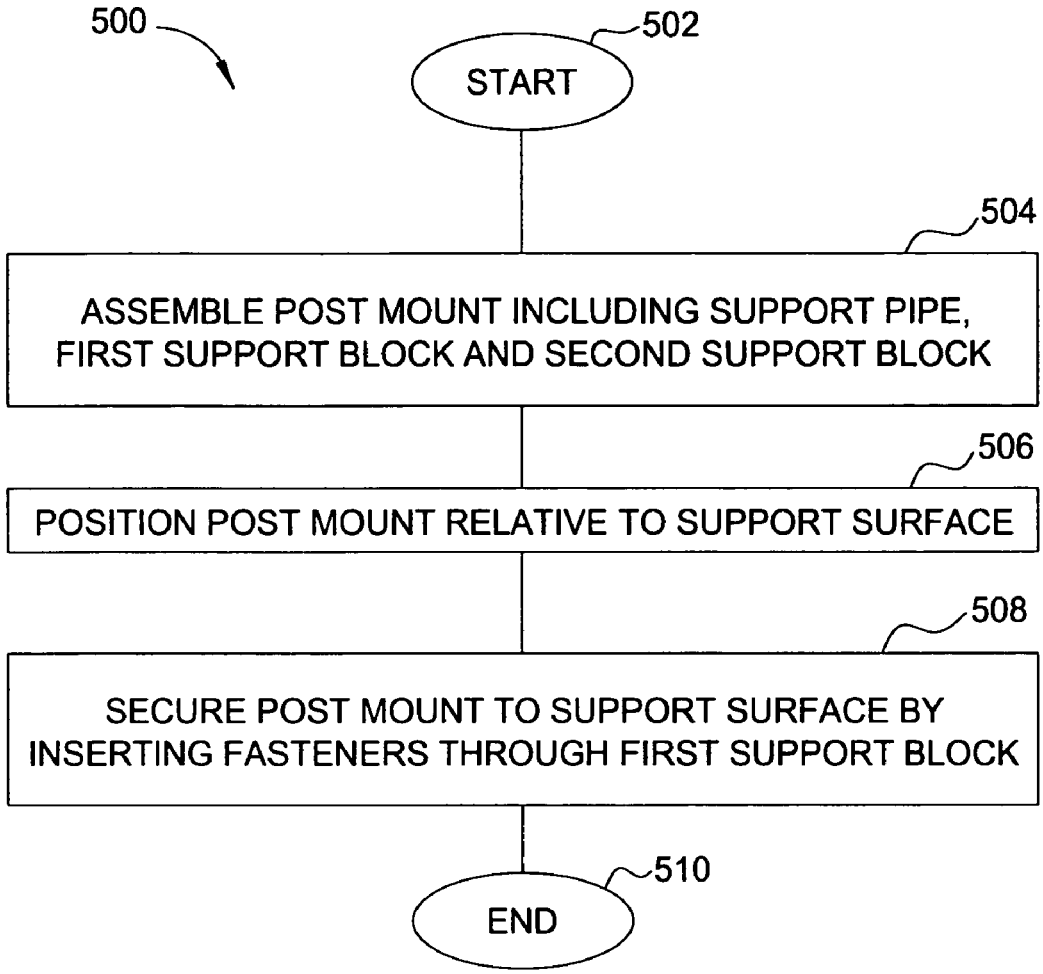
FIG. 5 is a flow diagram illustrating one embodiment of a method for installing a post mount, according to the present invention.
Figure 6:
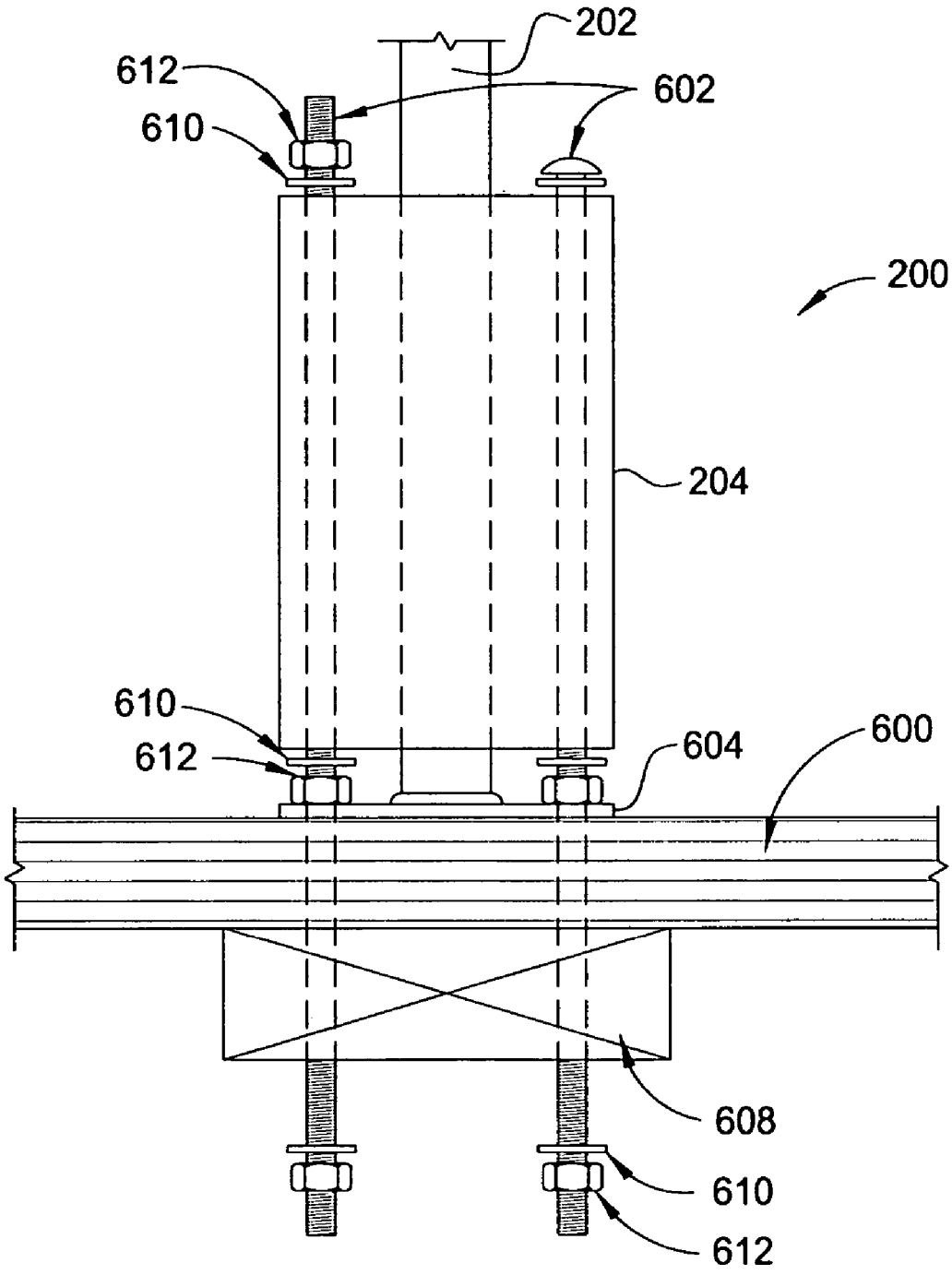
FIG. 6 is a schematic illustration of one end of a post mount installed in a wood support surface, in accordance with the method of FIG. 5.
Figure 7:
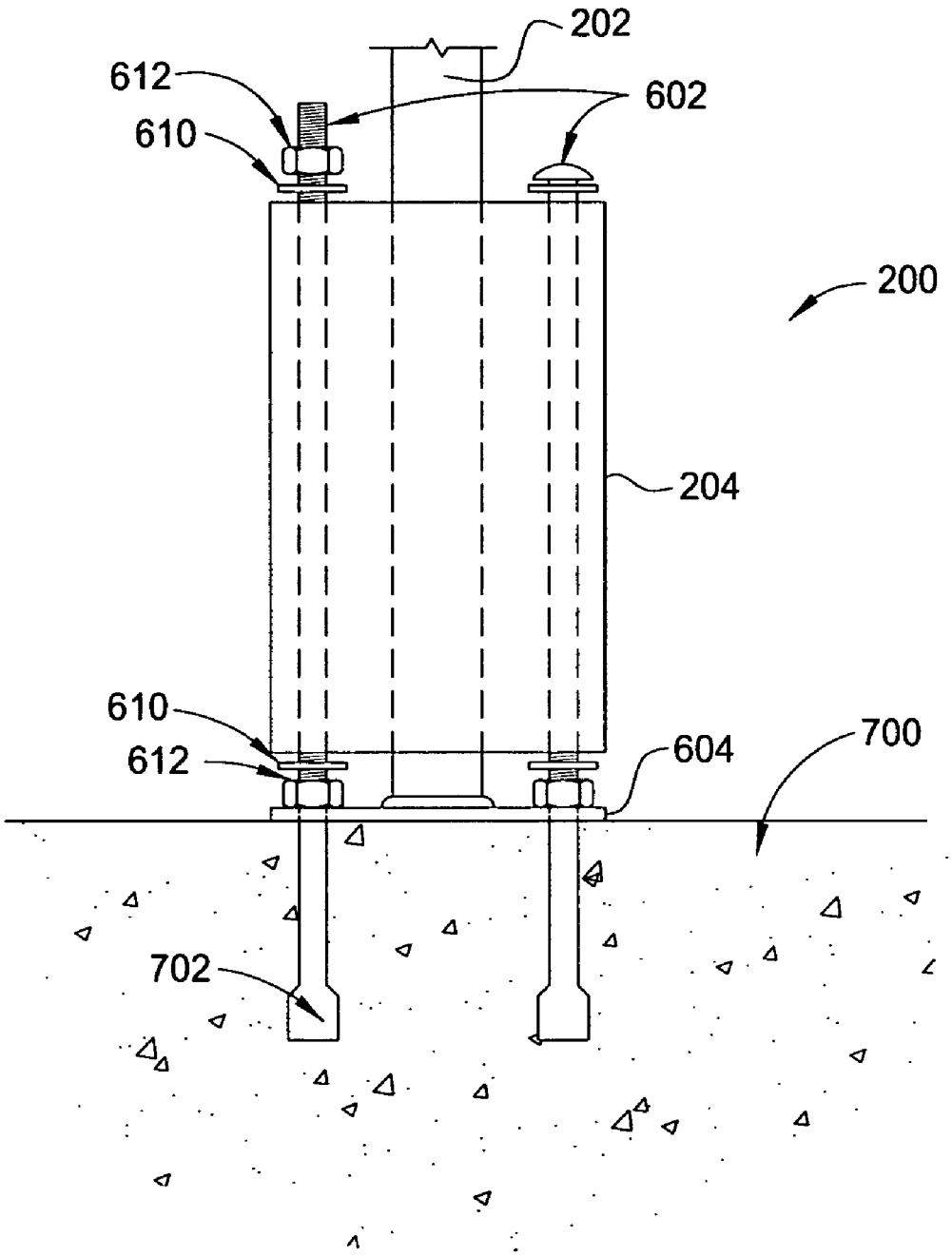
FIG. 7 is a schematic illustration of one end of a post mount installed in a concrete support surface, in accordance with the method of FIG. 5.

FIG. 5 is a flow diagram illustrating one embodiment of a method 500 for installing a post mount, according to the present invention. FIG. 6 is a schematic illustration of one end of a post mount 200 installed in a wood support surface 600, in accordance with the method of FIG. 5. FIG. 7 is a schematic illustration of one end of a post mount 200 installed in a concrete support surface 700, in accordance with the method of FIG. 5. Reference may be made simultaneously to FIGS. 5 through 7 in order to enhance understanding of the method 500 illustrated in FIG. 5.

The method 500 is initialized at step 502 and proceeds to step 504, where a post mount 200 is assembled including a support pipe, a first support block and a second support block, e.g., substantially in accordance with the configuration illustrated in FIG. 2. In one embodiment, assembly of the post mount 200 in accordance with step 504 further includes fitting an adapter (e.g., such as the adapter 206 illustrated in FIG. 4) over at least one of the first support block and the second support block, so that the post mount 200 can accommodate a larger-perimeter post.

In step 506, the post mount 200 is positioned relative to a support surface 600 or 700. In particular, the first support block 204 of the post mount 200 is positioned substantially flush with the support surface 600 or 700. In the embodiment illustrated in FIG. 6, the support surface 600 is wood (e.g., such as the floor of a wooden deck). In the embodiment illustrated in FIG. 7, the support surface 700 is concrete (e.g., such as a concrete patio).

In step 508, the post mount 200 is secured to the support surface 600 or 700 by inserting fastening hardware through the first support block 204. In one embodiment, securing of the post mount 200 in accordance with step 508 includes passing a fastener 602 (e.g., a threaded rod, a lag bolt, a carriage bolt or the like) through at least one corner volume (i.e., volumes $\mathbf{306}_1$, $\mathbf{306}_3$, $\mathbf{306}_5$ and $\mathbf{306}_7$ of FIG. 3B) of the first support block 204 and through the support surface 600 or 700. The fasteners 602 are secured in place using any necessary additional hardware (e.g., washers 610, nuts 612, etc.) to prevent slipping of the first support block 204 relative to the support surface 600 or 700.

In one embodiment, the post mount 200 further includes a support plate 604 disposed at one end thereof. In one embodiment, the support plate 604 is formed integrally with the support pipe 202 (e.g., by welding) and is positioned to separate the first support block 204 from the support surface 600 or 700. In this embodiment, the fasteners 602 pass through the support plate 604 as well as through the first support block 204 and the support surface 600 or 700. In one embodiment, the fasteners 602 pass through the first support block 204 in an orientation that is substantially parallel to the post mount's support pipe 202.

In the case of a wood support surface 600, securing the post mount 200 to the support surface 600 may be enhanced by additionally passing the fasteners 602 through a wood support 608 that is separated from the first support block 204 by the wooden support surface 600. In one embodiment, a head of at least one of the fasteners 602 is positioned to sit flush against the first support block 204 (e.g., separated by a washer). In another embodiment, a head of at least one of the fasteners 602 is positioned to sit flush against the support surface 600 or the wood support 608 (e.g., separated by a washer). The heads of the fasteners 602 are sized such that their perimeters are greater than the greatest width of the volume through which they are passed (i.e., to prevent travel of the fasteners 602 within the first support block 204).

In the case of a concrete support surface 700, securing the post mount 200 to the support surface 700 may be enhanced by additionally passing the fasteners 602 through wedge anchors 702 that are sunk into the support surface 700 and positioned to receive the fasteners 602.

Once the post mount 200 is firmly secured to the support surface 600 or 700, the method 500 is terminated in step 510. At this point, an appropriately-sized post may be slipped over the post mount 200.

Mounting the fastening hardware (e.g., fasteners 602, washers 610, bolts 612, etc.) through the first support block 204 allows the fulcrum or pulling point of the post mount 200 to be changed. Specifically, the fulcrum of the post mount 200 is moved up, from the bottom of the post mount 200 (i.e., the support plate 604) to the top of the first support block 204. This change in fulcrum enables higher pull testing of the post mount 200 (e.g., as opposed to fastening the post mount 200 directly to the support surface 600 or 700, via the support plate 604), ultimately resulting in a stronger post mount 200 (i.e., the post mount 200 is more resistant to upward force or pulling). Moreover, the post mount 200 also acquires the strength of the fastening hardware—that is, the fastening hardware does not just serve to fasten the post mount 200 to the support surface 600 or 700, but also enhances the strength of the post mount 200. For example, experimental results show that post mounts assembled in accordance with the present invention have tested to over 500 pounds of force (pulling).

Thus, the present invention represents a significant advancement in the field of railing systems. A method and apparatus are provided for strengthening the join where a post mount is secured to a support surface, resulting in a more secure mount over which to slip a post of a railing system. Moreover, the post mount can be easily adjusted to accommodate posts of various sizes, simply by slipping an adapter over a portion of the post mount.

Although various embodiments which incorporate the teachings of the present invention have been shown and described in detail herein, those skilled in the art can readily devise many other varied embodiments that still incorporate these teachings.

What is claimed is:

1. A method for securing a post mount to a support surface, the method comprising:

assembling said post mount, said post mount comprising:

a support pipe having a first end and a second end;

a first support block coupled to said first end of said support pipe; and a second support block coupled to said second end of said support pipe; and inserting at least one fastener through said first support block and through said support surface, wherein said assembling further comprises:

slipping at least one adapter over at least one of said first support block and said second support block, said at least one adapter being configured to increase an outer perimeter of said at least one of said first support block and said second support block, wherein said at least one adapter comprises:

a substantially square cross section having an outer perimeter and an inner perimeter that defines a substantially hollow interior volume; and a plurality of flanges extending inwardly from said inner perimeter to define an effective inner perimeter that is smaller in size than said inner perimeter.

2. The method of claim 1, wherein said effective inner perimeter is slightly larger than an outer perimeter of said at least one of said first support block and said second support block.

3. The method of claim 1, wherein said outer perimeter comprises a plurality of longitudinal ridges formed thereon.

4. The method of claim 1, wherein said plurality of flanges are positioned to contact an outer perimeter of said at least one of said first support block and said second support block.

5. The method of claim 4, wherein said plurality of flanges are further positioned to rest substantially flush against a plurality of longitudinal ridges formed on said outer perimeter of said at least one of said first support block and said second support block.

6. The method of claim 1, wherein said support surface is a wood support surface.

7. The method of claim 6, wherein said at least one fastener is further inserted through a wood support that is separated from said first support block by said support surface.

8. The method of claim 1, wherein said support surface is a concrete support surface.

9. The method of claim 8, wherein said at least one fastener is further inserted through a wedge anchor sunk into said support surface.

10. The method of claim 1, wherein at least one of the first support block and the second support block is formed of at least one of: a rigid plastic or a rigid composite.

11. The method of claim 1, wherein at least one of the first support block and the second support block has a substantially square cross section having an outer perimeter and an inner perimeter.

12. The method of claim 11, wherein a longitudinal bore is defined substantially in a center of the substantially square cross section, the longitudinal bore being sized to receive said support pipe.

13. The method of claim 12, wherein a plurality of flanges extend outwardly from said longitudinal bore to said inner perimeter, said plurality of flanges defining a plurality of hollow longitudinal volumes within said substantially square cross section.

14. The method of claim 13, wherein said at least one fastener is inserted through at least one of said plurality of hollow longitudinal volumes.

15. The method of claim 11, wherein said outer perimeter comprises a plurality of longitudinal ridges formed thereon.

16. The method of claim 1, wherein said at least one adapter is formed of at least one of: a rigid plastic or a rigid composite.

* * * * *